US005355706A

United States Patent [19]

Deriaz et al.

[11] Patent Number: 5,355,706

[45] Date of Patent: Oct. 18, 1994

[54] PROCESS FOR THE PRODUCTION OF A HOLLOW WORKPIECE BEING PROFILED AT LEAST INTERNALLY IN A STRAIGHT OR HELICAL MANNER RELATIVE TO THE WORKPIECE AXIS

[75] Inventors: Daniel Deriaz, Meilen; Hans Krapfenbauer, Kuesnacht, both of Switzerland

[73] Assignee: Ernst Grob AG, Mannedorf, Switzerland

[21] Appl. No.: 85,155

[22] Filed: Jul. 2, 1993

[30] Foreign Application Priority Data

Jul. 16, 1992 [CH] Switzerland ..... 02 246/92-8

[51] Int. Cl.[5] ..... B21D 22/16

[52] U.S. Cl. ..... 72/83; 72/96

[58] Field of Search ..... 72/82, 83, 84, 85, 96; 29/893.32

[56] References Cited

U.S. PATENT DOCUMENTS 3,354,535 11/1967 Winnai et al. ..... 72/83
4,796,345 1/1989 Krapfenbauer ..... 29/893.32
4,872,250 10/1989 DeMarco ..... 29/159.2

FOREIGN PATENT DOCUMENTS 2549230 9/1978 Fed. Rep. of Germany .
3932823 12/1990 Fed. Rep. of Germany ... 29/893.32
2301318 9/1976 France .
579427 7/1976 Switzerland .
2187406 9/1987 United Kingdom ..... 72/84

*Primary Examiner*—Lowell A. Larson
*Attorney, Agent, or Firm*—Sandler, Greenblum & Bernstein

[57] ABSTRACT

The well known Grob method, as practiced on a Grob machine, uses at least a partially profiled mandrel wherein during a cold forming operation, via a forming or impact roller of a workpiece blank, produces a hollow workpiece that is profiled at least internally wherein the material is shaped radially as well as axially in a single operation and the axial and radial shaping of the workpiece blank is achieved at least internally as a whole or in part in a straight or helical manner relative to the workpiece axis, by means of this forming roller and achieves the economical production of high quality workpieces in a single operation, with outer profiling also being achievable, and the difference (D) between the outer radius (RO) of the workpiece blank and the outer radius (RD) of the mandrel preferably being the same as or smaller than the length (WL) of the finished workpiece.

7 Claims, 5 Drawing Sheets

PROCESS FOR THE PRODUCTION OF A HOLLOW WORKPIECE BEING PROFILED AT LEAST INTERNALLY IN A STRAIGHT OR HELICAL MANNER RELATIVE TO THE WORKPIECE AXIS

CROSS REFERENCE TO RELATED APPLICATIONS

This application claims the priority of Swiss Application No. 02 246/92-8, filed Jul. 16, 1992, the disclosure of which is incorporated herein by reference in its entirety.

BACKGROUND OF THE INVENTION

1. Field of the Invention

The invention pertains to a new or improved method or process for the production of workpieces that are at least internally profiled in a straight or helical manner and, relative to the workpiece axis, if desired, can also have an outer profile that is straight or helical relative to the workpiece axis.

When profiling is produced on both the inside and outside surfaces, more or less close similarity or far reaching differences between the inner and outer profile can be produced.

The profiling can, if required, also be limited to axially extending areas and/or in circumferentially extending areas. A typical example of such a profile could be a gear.

2. Discussion of the Background of the Invention and Material Information

For the production of quality precision profiles, for example, gearing or toothing, relative to hollow workpieces, the well known Grob method is outstanding. This method will be summarized hereinafter even though in this particular technology or art, both from documentation as well as from actual practice, it is of world renown and no further explanation is needed for those skilled in this art.

For example, the special development of the Grob method, which permits the fabrication of an outer toothing or gearing in a relatively thick-walled hollow workpiece, is disclosed in Swiss Patent No. 579,427, in French Patent No. 75 385 39 and in German Patent No. 25 49 230, to which reference may be readily had and the disclosures of which are incorporated herein by reference. With these methods, different toothings or gear tooth systems can be fabricated on the inside and the outside of the workpiece.

In a relatively thin-walled hollow workpiece, the Grob method permits fabrication, via cold forming or cold working, to simultaneously produce an outer profile and an inner profile, whose profiles may differ. For this, the tubular portion of the raw or unfinished workpiece is mounted on a specific mandrel or holder whose external toothing or teeth correspond to the internal toothing or teeth of the workpiece which is to be fabricated. The workpiece in this setup is infed or advanced along its workpiece axis and turned or rotated relative thereto. During this workpiece feed, the workpiece is externally worked by annular or ring-like profiled forming rolls or rolling tools, whereby each forming roll or rolling tool performs single or individual blow-like or impact-forming operations in rapid succession, in coupled sequence, in the direction of the advance of the workpiece. The single or individual blow-like impact or forming operations are consecutively carried out by the same forming roll or rolling tool in a screw-like or helical zone determined by the infeed of the workpiece. The consecutively following single forming processes, in the direction of the profile, within the same tooth spacing, are accomplished as operations on the workpiece in a partially overlapping manner. In the process of cold forming on the profiled mandrel during each single blow-like or impact forming operation, material is pushed along a relatively small section of the workpiece into the depressions of the mandrel, namely flowing mainly in a radial direction.

With relatively thick-walled workpieces, inner profiles can only be produced via the use of a profiled mandrel. If the form or shape of the outer surface is not of great consequence, it can be finished more or less smooth or even. Rolling heads or forming tools without any profiling may be utilized since they do not have to be exactly synchronized with reference to the rotation of the workpiece.

The production of such hollow workpieces, in the prior state of technical development, substantially dished or pot-shaped hollow workpieces are first produced, as a rule, on very expensive step or transfer presses, in multiple steps. It is only after the last pressing step that the unfinished or hollow bodies can be transferred to Grob machines and mounted on mandrels or holders thereon and be subsequently finished or further worked upon via the Grob method.

SUMMARY OF THE INVENTION

The primary purpose or objective of this invention is to produce, via the Grob method, a hollow profiled workpiece that is at least internally fully or partially straight or helical, relative to the workpiece axis, even more economically and more advantageously than before, without loss of quality.

For this purpose the known Grob method can be utilized on the known Grob machine, the latter having the following parts: An axially movable and rotatable workpiece receiving portion equipped with a mandrel, the mandrel being profiled in a straight or helical manner, relative to its axis and to that of the workpiece axis; and a rolling head carrier having a rotatable rolling head, the latter having journalled therein, and rotatable therewith in a planetary manner, at least one forming roller, the latter carrying out a partial forming step on the workpiece blank during every rotation of the rolling head, with the workpiece blank being co-axial with the mandrel.

In the process of this invention the workpiece blank, mounted in the Grob machine is cold formed via the Grob method in a single operation.

Up to this time it had been deemed absolutely necessary, in order to obtain the required precision, to first produce a hollow workpiece blank. It was from this previously produced hollow workpiece blank that the hollow workpiece was produced via cold forming by utilizing the Grob method, with the workpiece being profiled at least internally in a straight or helical manner relative to the workpiece axis. Thus, two shaping or forming operations were always necessary.

It has been surprisingly determined that a hollow workpiece, being profiled at least internally in a straight or helical manner, can be produced on a Grob machine, via cold forming by the Grob method, without first producing a hollow workpiece blank, according to the invention, by starting with a flat or dish-shaped workpiece blank having a suitable diameter. Preferably, the difference between the outer radius of the workpiece blank and the outer radius of the mandrel is the same as or smaller than the length of the workpiece.

Specifically, this invention sets forth a method for the production of a hollow workpiece having an at least internal straight or helical internal profile, relative to the workpiece axis, said workpiece having at least a partial web portion and a substantially tubular rim portion connected to said web portion, with the workpiece having a predetermined length, wherein the method includes the steps of providing a workpiece blank or disk having a predetermined first radius; and providing a set-up including a workpiece retaining means and a mandrel which possesses an external profile corresponding to the internal profile which is to be fabricated on at least a portion of the workpiece blank. The method proceeds via the cold forming the workpiece blank on the mandrel into the hollow workpiece having the noted web and rim portions, with the mandrel having a predetermined second radius. This is followed by cold working the rim portion of the hollow workpiece on the mandrel according to the Grob method to form the hollow workpiece with at least an internal profile on the rim portion thereof; whereby the cold forming and the cold working are performed substantially simultaneously in a single operation, with both axial and radial material movement occurring in the workpiece blank thereby directly cold forming the hollow workpiece.

In the method of this invention, the forming step entails using at least one forming roller, drivingly journalled in a rotating rolling head, in conjunction with the workpiece retaining means and the mandrel. In addition, the forming step includes both axial and radial material movement in the workpiece blank, via the forming roller.

Preferably, the difference between the first outer radius of the workpiece blank and the second outer radius of the mandrel is in a range of smaller than to the same as the predetermined length of the workpiece. Preferably, the workpiece blank is flat or dish-shaped.

In one embodiment of the invention the at least one forming roller, when viewed in radial section, is substantially without profile and concave in shape.

In another embodiment of the invention the at least one forming roller, when viewed in radial section, has a ring-shaped profile, with concave areas adjacent to the ring-shaped profile, for producing a hollow workpiece also having an outer straight or helical profile relative to the workpiece axis.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Figure 1:
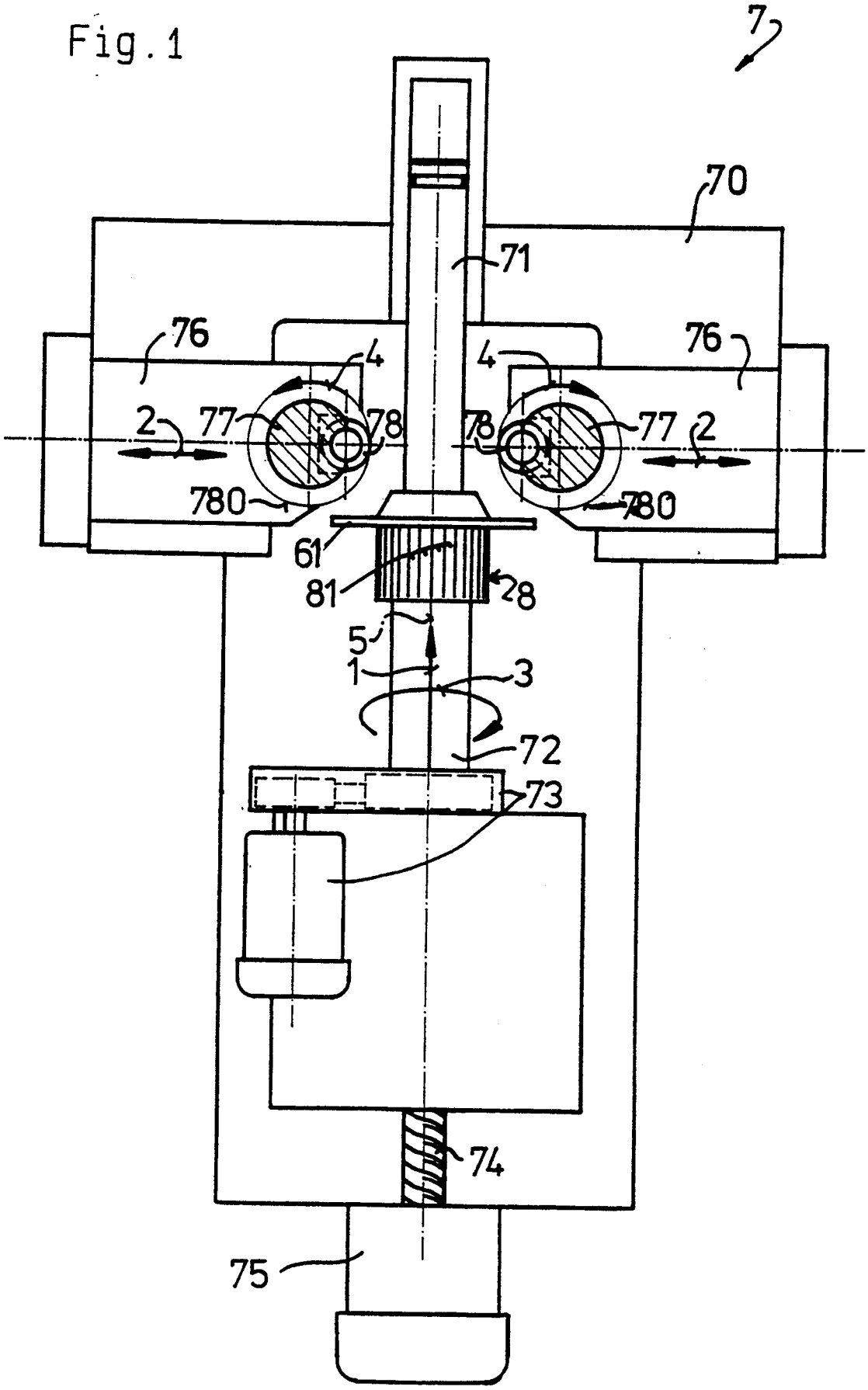
FIG. 1 is a top plan view of an operationally ready apparatus with a mounted, flat, workpiece disk.
Figure 2:
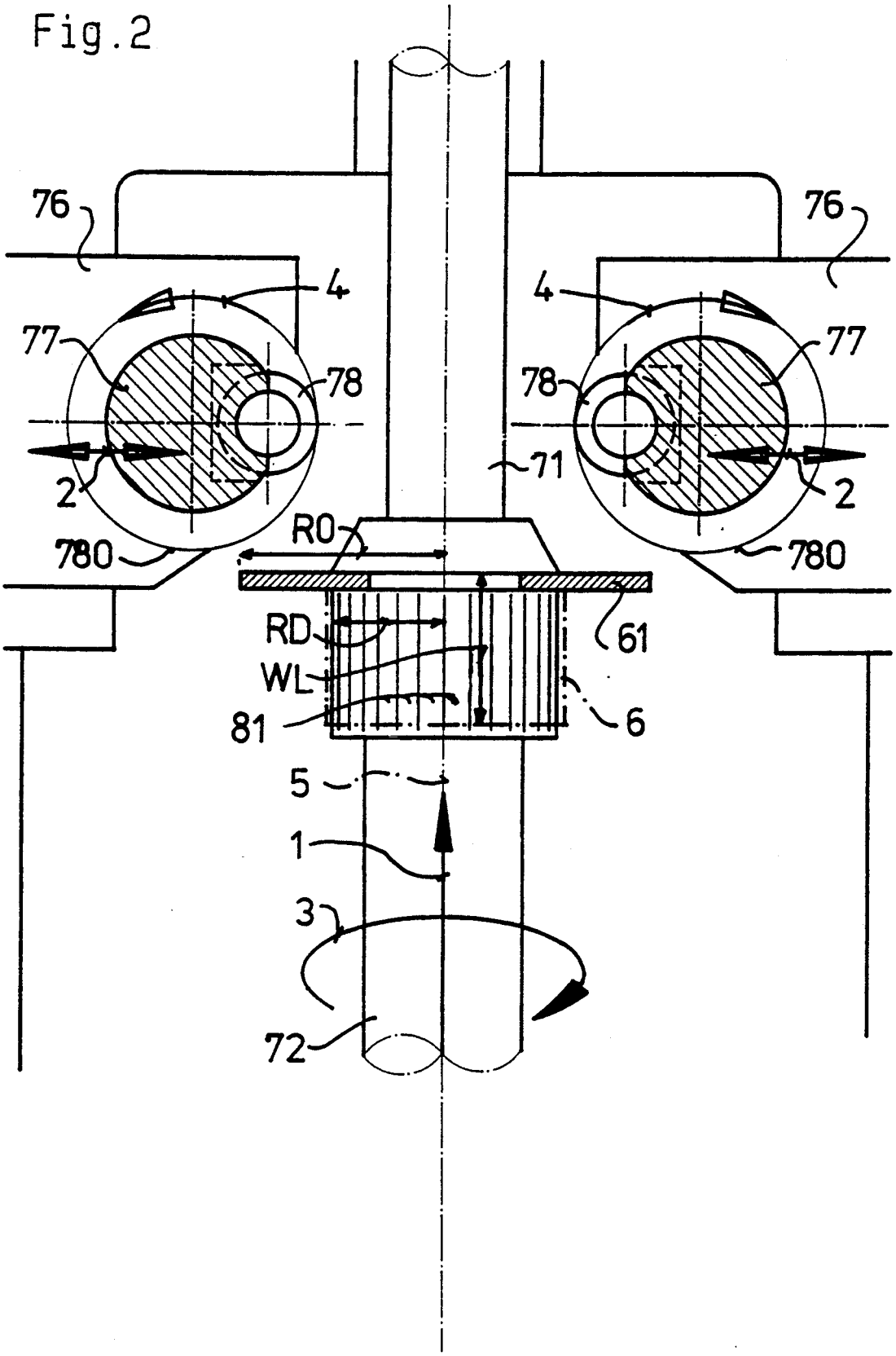
FIG. 2 is an enlarged top plan view portion of FIG. 1, with the workpiece disk in section, prior to the start of the cold forming operation.
Figure 3:
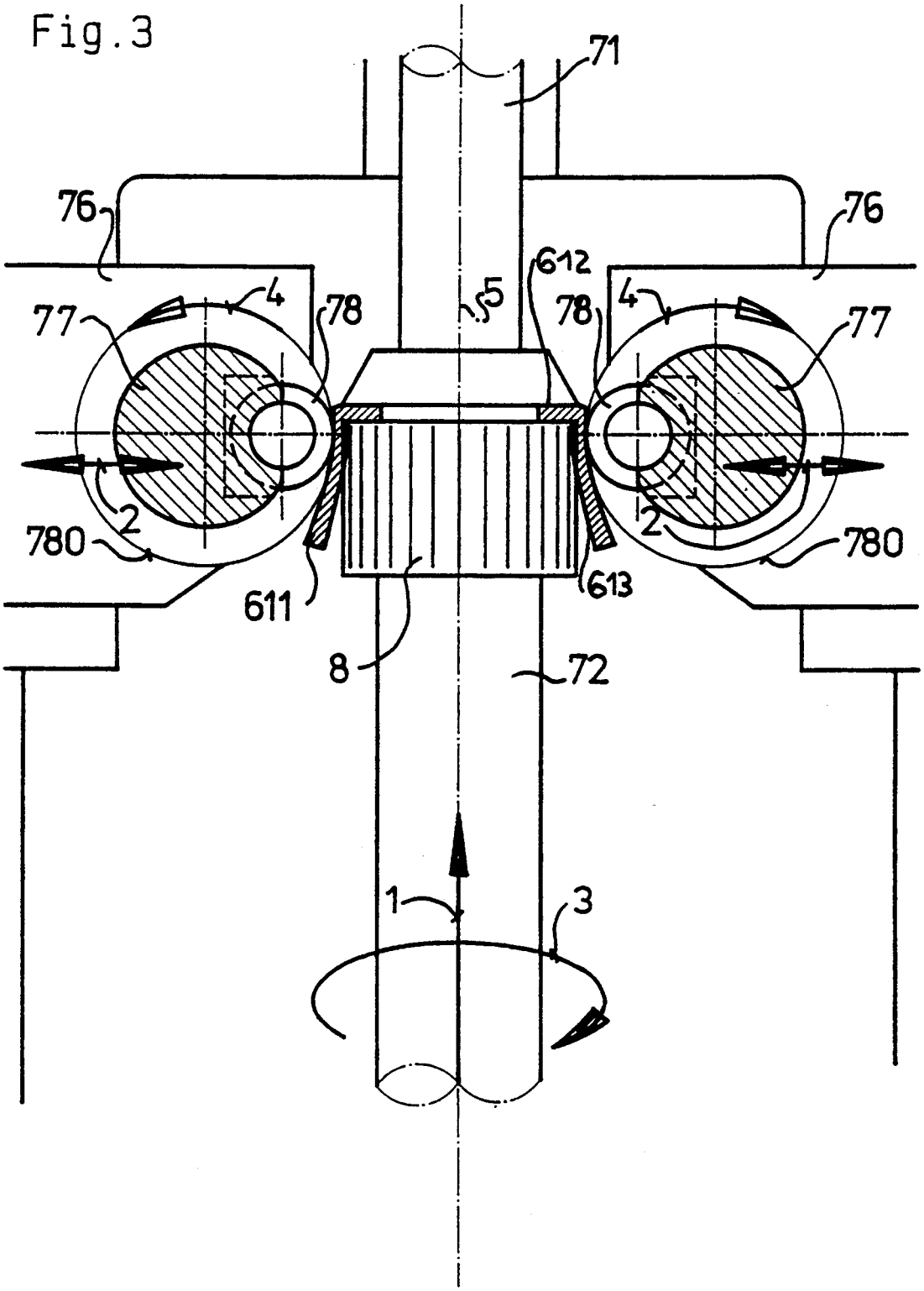
FIG. 3 is the FIG. 2 portion, with the workpiece disk in section, during the single cold forming operation, via the use of forming rollers, as per the Grob method.
Figure 5:
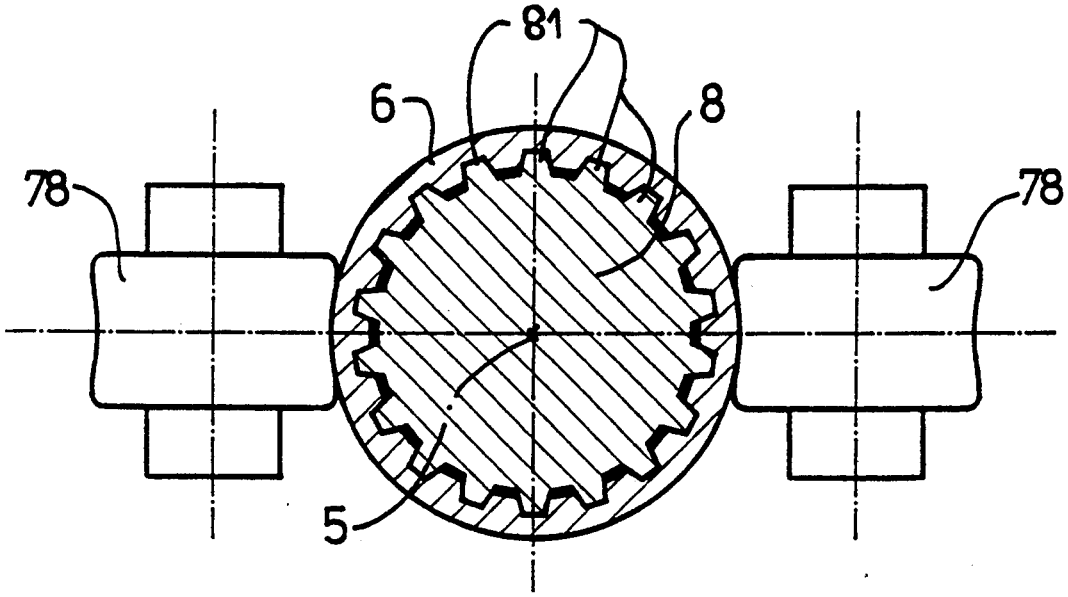
FIG. 5 is a cross section of only an inner profiled workpiece mounted on a mandrel with its associated, essentially profile-less forming rollers.

Before beginning an extensive discussion of the drawings, there will now be first listed the various elements and reference characters depicted therein and their significance as follows:

1: axial thrust direction of workpiece 6
2: In and outfeed direction
3: direction of rotational movements of workpiece 6
4: direction of rotation of forming tool 77
5: workpiece axis, here coaxial with the mandrel axis
6: workpiece with internal gearing or toothing (FIG. 5)
60: workpiece with internal and external gearing or toothing (FIG. 6)
61: workpiece blank
611: work piece in process (partially formed), in FIG. 3)
612: web portion of 6 or 60 or 611
613: tubular rim portion of 6 or 60 or 611
7: device or apparatus
70: machine frame
71: retaining punch or die
72: reciprocal, opposing or counterpunch
73: rotational drive for counterpunch 72
74: screw spindle or lead screw
75: drive means for 74 (axial drive for 72)
76: rolling head carrier or forming tool carrier
77: rolling head or forming tool
78: impact/cold former or forming roller for 6
780: rotational circular periphery of 78
781: impact/cold former or forming roller for 60
8: mandrel for 6
80: mandrel for 60 (FIG. 6)
81: profile or toothing of 8
D: difference of RO minus RD
RD: outer radius of the mandrel
RO: outer radius of workpiece blank
WL: workpiece length Turning now to the drawings, wherein the invention is illustrated in sufficient detail to permit one to readily understand the present invention, apparatus 7, as shown in FIG. 1, utilizes a retaining punch or die 71 mounted in machine frame 70 coaxial with mandrel axis 5, which also corresponds with the workpiece axis. The movement of counterpunch 72, also located on axis 5, moves or controls punch 71.

Between the two punches or dies 71, 72, a workpiece blank 61 and a mandrel 8 are shown in an already clamped condition.

Figure 4:
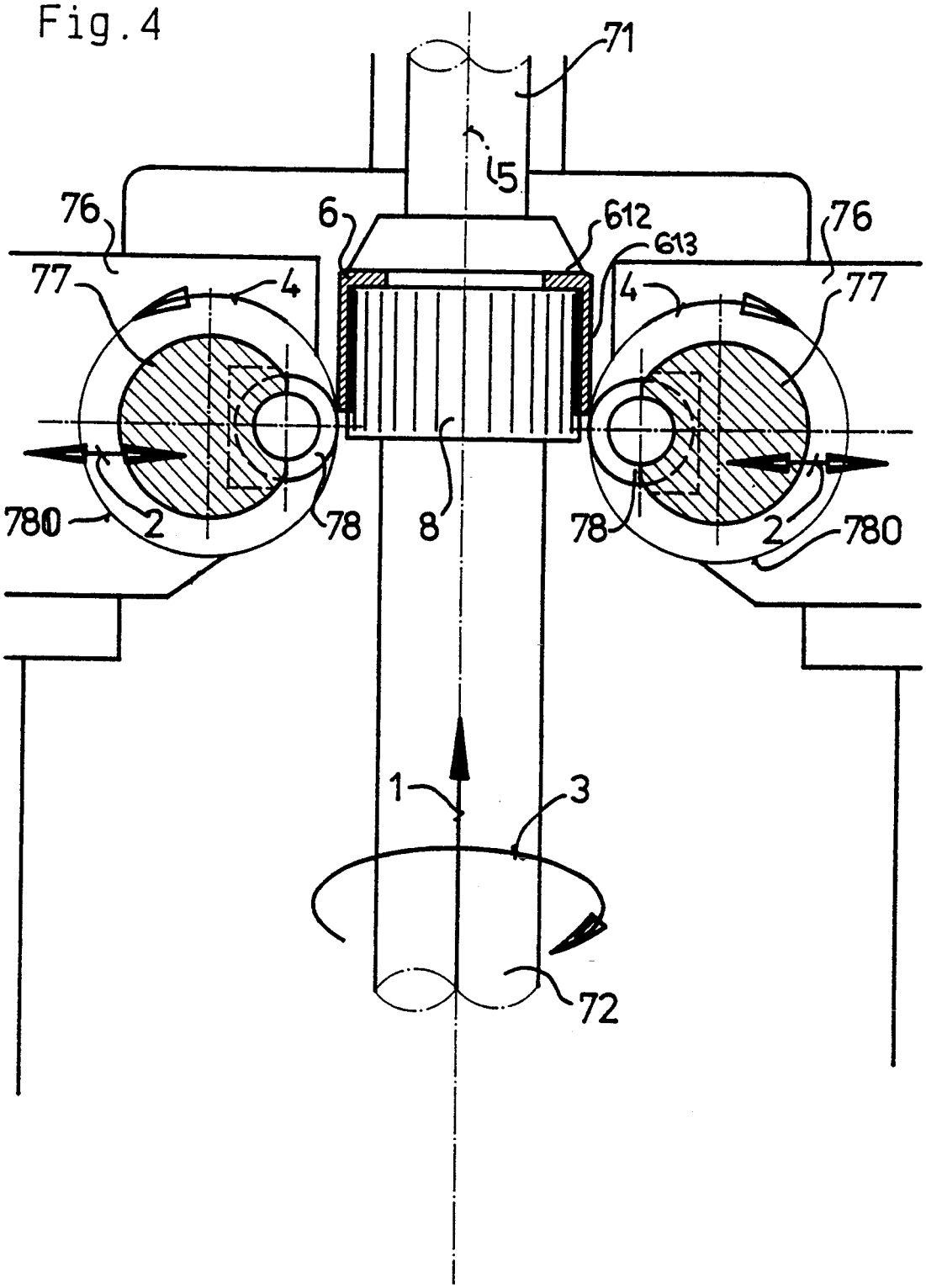
FIG. 4 is the FIG. 2 portion, with the workpiece disk in section, after the cold forming operation, via the use of forming rollers, as per the Grob method.

The counter punch 72 can be driven by rotational drive means 73 in the direction of arrow 3 whereby mandrel 8 and workpiece blank 61, that is the work piece in process 611 (FIG. 3) and finally the finished workpiece 6 (FIG. 4) are rotated therewith.

In addition, counterpunch 72 can be axially advanced in the direction of arrow 1, by means of drive means 75, via lead screw 74.

If desired, drive movements 1 and 3 can be synchronized, for example, by means of electronic controls or devices (not shown) with the rotation of forming rollers 78 in rolling heads 77 which rotate in the directions shown by arrows 4.

In machine frame 70 there are two opposed rolling head carriers 76 which can, via adjustment plungers (not shown) be moved in the direction of double headed arrows 2, relative to axial thrust direction 1, toward or away therefrom. In normal operation, in the illustrated embodiment, a correct distance is set and left unchanged until the forming or rolling is finished, or the distance is changed during the process of rolling utilizing a numerical control spindle in accordance with the desired technological requirements. For reversing and for the ejection of the finished workpiece, the necessary adjustments may of course be made.

In each of rolling head carriers 76 a rolling head 77 is drivingly journalled. The drive can be by any desired known means. The rolling heads 77 are driven in opposite directions 4 in a synchronous manner so that the impact formers or rollers 78 mounted thereon simultaneously act on workpiece blank 61 or partially formed workpiece 611. In addition, synchronization can be achieved for rotational movement of the workpiece blank 61, or partially formed workpiece 611, via non-illustrated by well known mechanical or electronic means.

Each of rolling heads 77 is shown here as having but a single impact or forming roller 78. Additional rolling heads could also be utilized which will necessitate changing of the drive means accordingly.

The inventive method for the production of the profiled workpiece 6 proceeds in the following manner:

The flat workpiece blank 61 is mounted in the manner shown in FIG. 1 with the workpiece blank also being plate-shaped if desired. Now the impact or cold forming steps, according to the Grob method can now be initiated. Therewith, the workpiece is formed axially as well as radially, relative to axis 5.

The impact or cold forming operation simultaneously produces, in a manner previously unknown in the Grob method, a diameter reduction of workpiece blank 61 so as to form or shape a hollow body taking the shape of a can or container, having a partial web portion 612 connected with a substantially tubular rim portion 613, and the reshaping of the hollow body into workpiece 6. During the transition from a pot-shaped or disk-shaped part to the final workpiece form an intermediate product is achieved which, for example, approximates the partially formed or workpiece-in-process 611 comprised of web portion 612 and rim portion 613. In this partially formed workpiece 611 it is in the area thereof, adjacent or abutting with mandrel 8, namely rim portion 613, in manner typically associated with the Grob method, that eventually produces the inner toothing or profiling of workpiece 6 through a step-wise forming or shaping via the profile or toothing 81 of mandrel 8.

In this manner, the method or process, for example, proceeds as follows:

The workpiece blank 61, having a metal wall thickness of 5 mm, and an outer radius RO of 104 mm, is clamped, in the manner shown in FIG. 1, between mandrel 8, having an outer radius of 65 mm, and retaining punch or die 71, into device or apparatus 7, that is the Grob machine.

The Grob machine is activated in order to produce workpiece 6 directly from workpiece blank 611, wherein the number of revolutions of the rolling head is 1400 revolutions per minute; the number of rotations of the workpiece is 35 revolutions per minute and the workpiece axial or length advance is 1000 mm per minute.

At the end of the cold forming process, via the Grob cold rolling method, a workpiece 6 is produced, on mandrel 8, that is internally axially profiled or toothed, having a workpiece length WL of 71 mm. Here the workpiece length WL (71 mm) is greater than RO (104 mm) minus RD (65 mm). In other words, the difference of RO (104 mm) minus RD (65 mm) is smaller (39 mm) than WL (71 mm).

Figure 6:
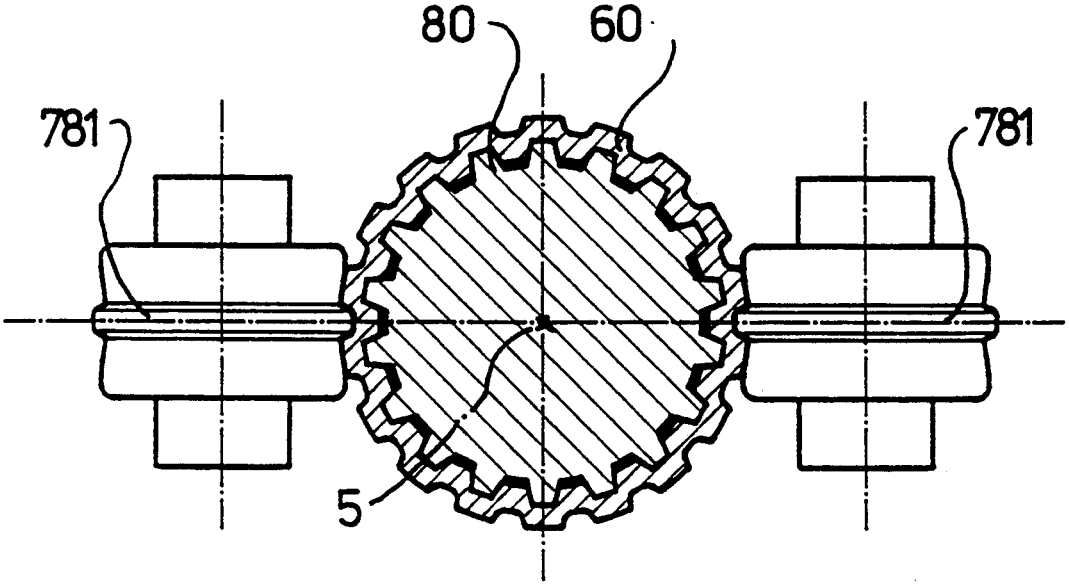
FIG. 6 is a cross-section through an internally and externally profiled workpiece mounted on a mandrel with its associated forming roller, the latter having a ring-shaped profile.

When mandrel 8 is replaced with mandrel 80, as in FIG. 6, and impact formers 78 are replaced with impact formers 781, as in FIG. 6, and when the movement of the workpiece revolutions are synchronized with the number of revolutions of the rolling head there is obtained, without any other changes, in apparatus or working steps, a profiled workpiece 60 (FIG. 6) that is provided with inner and outer toothed profiles in the known manner of the Grob method.

If desired, differing or diverging inner and outer profiles can be obtained when utilizing the Grob method in a known manner although not shown here. In such a situation different profiles on the mandrel and on the impact rollers are utilized.

Use of a smooth or partially smooth mandrel, that is a mandrel that is only partially toothed or profiled, allows the production of a partially internally smooth workpiece which is not illustrated here in any greater detail.

As will be understood from the previous description, with the use of this inventive process or method the economical production of profiled hollow workpieces can be achieved with a single set-up in a single operation. In addition, the same quality is maintained as had been previously obtained by the use of the Grob method using the prior process with previously produced blank hollow bodies.

While there are shown and described present preferred embodiments of the invention, it is to be distinctly understood that the invention is not limited thereto, but may be otherwise variously embodied and practiced within the scope of the following claims.

What is claimed is:

1. A method for the production of a hollow workpiece having an internal straight or helical internal profile, relative to the workpiece axis, said workpiece having at least a partial web portion and a substantially tubular rim portion connected to said web portion, with said workpiece having a predetermined length, said method comprising the steps of:

providing a workpiece blank or disk having a predetermined first radius;

providing a set-up including a workpiece retaining means and a mandrel which possesses an external profile corresponding to the internal profile which is to be fabricated on the tubular rim portion of the workpiece blank;

cold forming said workpiece blank on said mandrel into said hollow workpiece having said web portion and said substantially tubular rim portion, said mandrel having a predetermined second radius;

said forming step utilizing two opposed impact formers, drivingly journalled in a rotating rolling head, in conjunction with said workpiece retaining means and said mandrel;

cold working said rim portion of said hollow workpiece on said mandrel according to the known Grob method of impact roller forming to form the hollow workpiece with said an internal profile on the rim portion thereof; and whereby said cold forming and said cold working are performed substantially simultaneously in one operation, with both axial and radial material movement occurring in said workpiece blank thereby directly cold forming and cold working said hollow workpiece.

2. The method of claim 1 wherein the difference between said first radius of said workpiece blank and said second radius of said mandrel is in a range of smaller than to the same as the predetermined length of said workpiece.

3. The method of claim 1 wherein said impact former, when viewed in radial section, is substantially concave in shape.

4. The method of claim 1 wherein said workpiece blank is essentially flat.

5. A method for the production of a hollow workpiece having at least a partial web portion and a substantially tubular rim portion connected to said web portion, said workpiece having a predetermined length, said rim portion having an internal straight or helical profile, relative to the workpiece axis, said method comprising the steps of:

providing a workpiece blank or disk having a predetermined first radius;

providing a set-up including a workpiece retaining means and a mandrel which possesses a profile corresponding to the profile which is to be produced on an internal surface portion of the tubular rim of the workpiece blank;

cold forming said workpiece blank on said mandrel into said hollow workpiece having said web portion and said substantially tubular rim portion, said mandrel having a predetermined second radius;

said forming step utilizing two diametrically opposed impact formers, drivingly journalled in a rotating rolling head, in conjunction with said workpiece retaining means and said mandrel;

cold working said rim portion of said hollow workpiece on said mandrel according to the known Grob method of impact roller forming to form the hollow workpiece with a profile on the rim portion thereof; and whereby said forming and said cold working are performed substantially simultaneously in one operation, with both axial and radial movements occurring in said workpiece blank thereby directly cold forming and cold working said hollow work piece.

6. The method of claim 5 wherein the difference between said first radius of said workpiece blank and said second predetermined radius of said mandrel is in the range of smaller than to the same as the predetermined length of said workpiece.

7. The method of claim 5 wherein said workpiece blank is substantially flat.

* * * * *